United States Patent [19]

Pierman

[11] Patent Number: 4,629,193

[45] Date of Patent: Dec. 16, 1986

[54] GOLF PUTTER HEAD

[76] Inventor: Martin J. Pierman, 3212 Eastlake Dr. N., Elkhart, Ind. 46514

[21] Appl. No.: 796,185

[22] Filed: Nov. 7, 1985

[51] Int. Cl.[4] ..... A63B 53/02; A63B 53/04; A63B 69/36

[52] U.S. Cl. ..... 273/164; 273/169; 273/80 A; 273/183 D; 273/80 C

[58] Field of Search ..... 273/163 R, 164, 163 A, 273/183 D, 186 A, 194 A, 193; D21/217, 218, 219

[56] References Cited

U.S. PATENT DOCUMENTS

D. 272,257 1/1984 Perkins ..... D21/219
4,136,877 1/1979 Antonious ..... 273/164

OTHER PUBLICATIONS

"Golf Digest", Nov. 1983, p. 35.

*Primary Examiner*—George J. Marlo

*Attorney, Agent, or Firm*—Thomas R. Vigil

[57] ABSTRACT

The golf putter head has an elongate side-to-side extending body portion with a front face adapted to be positioned in a generally vertically extending plane. A forward upper face has a short notch extending along an axis which is referred to as the X axis and is perpendicular to the front face. Notches extend on either side of the short notch extending along the line defined as a Y axis which is parallel to the plane containing the front face and which is perpendicular to the X axis. A riser portion extends upwardly and rearwardly from the elongate body portion, and an upper tier member extends from the upper end of the riser portion forwardly toward the front face. The upper tier member has an upper surface which has a slot that lies on an upper X axis and a short notch forming slot in the front forward end thereof which lies on an upper Y axis. The upper and lower X axis are in the same plane and the upper and lower Y axis are in the same plane. An extension arm is provided for connecting a shaft to said riser.

16 Claims, 10 Drawing Figures

GOLF PUTTER HEAD

BACKGROUND OF THE INVENTION

1. Field of the Invention

The present invention relates to golf putter heads, and more specifically to a unique and novel golf putter head which has unique alignment features, unique balancing features and unique antitwisting or antitorquing features.

2. Description of the Prior Art

Heretofore many attempts have been made to develop a golf putter head which has good balance, has alignment features and which hopefully will prevent twisting of the golf putter head in a horizontal plane about an upwardly extending axis either along the shaft of the golf club or the vertical axis when a ball is hit slightly off center by the golf putter head.

Some examples of the previously proposed golf putter heads are disclosed in the following patents:

| U.S. Pat. No. | | PATENTEE |
|---|---|---|
| Des. | 221,446 | Cook |
| Des. | 222,719 | Cook |
| Des. | 234,206 | Cook |
| Des. | 234,782 | Creed |
| Des. | 235,074 | McCabe |
| Des. | 235,893 | Becker |
| Des. | 240,366 | Cook |
| Des. | 240,445 | Becker |
| Des. | 246,329 | Little |
| Des. | 255,373 | Solheim |
| Des. | 259,801 | Vella |
| Des. | 271,604 | Stone et al |
| | 3,880,430 | McCabe |
| | 4,128,244 | Duclos |
| | 4,136,877 | Antonious |
| | 4,458,900 | Antonious |
| | 4,461,482 | Bojicic |
| | 4,484,746 | Brill |

As will be described in greater detail hereinafter, the golf putter head of the present invention provides a two tier X and Y axis alignment feature that is not provided in any of the prior art putter heads disclosed in the patents referred to above.

Furthermore, the golf putter head of the present invention has a riser and upper tier member connected to and integral with a lower side-to-side elongate body portion having different weight portions on either side of the elongate extent of the golf putter head to provide balancing through a Z axis extending vertically through the upper tier member. Additionally, an arm extension connected to the upper tier member having a socket for receiving a golf club shaft provides a construction which facilitates and enhances antitwisting or antitorquing of the golf putter head about an upwardly extending axis, either a vertical axis or an axis parallel to the axis of the shaft of the golf club, when a golf ball is hit at a point other than the center point on the front face of the golf putter head. Additionally, coarse alignment is provided with indicia on the riser.

SUMMARY OF THE INVENTION

According to the present invention there is provided a golf putter head having an elongate side-to-side extending body portion with a front face adapted to be positioned in a generally vertically extending plane and a forward upper face having a short notch extending along an axis which is referred to as the X axis and is perpendicular to the front face and having notches on either side of the short notch extending along an axis defined as a Y axis which is parallel to the plane containing the front face and which is perpendicular to the X axis, a riser portion extending upwardly and rearwardly from the elongate body portion, and an upper tier member extending from an upper end of said riser portion forwardly toward said front face and having an upper surface which has a slot that lies on an upper X axis and a short notch forming slot in the front forward end thereof which lies on an upper Y axis, the upper and lower X axes being in the same plane and the upper and lower Y axis being in the same plane, and means for connecting a golf club shaft to said riser portion.

DESCRIPTION OF THE PREFERRED EMBODIMENT

Figure 1:
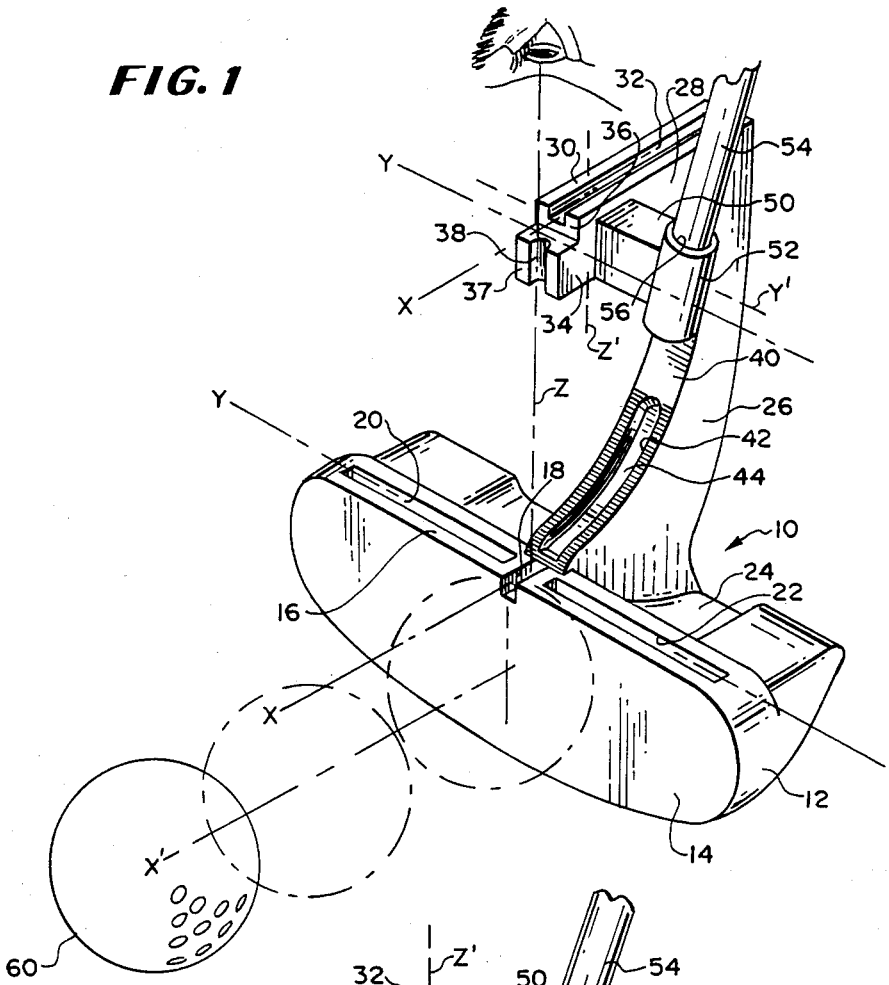
FIG. 1 is a perspective view of a golf putter head constructed according to the teachings of the present invention and shows the manner in which one would look downwardly at the putter head when aligning the putter for use in putting a golf ball.

Referring now to the drawings in greater detail, there is illustrated in FIG. 1 a golf putter head which is generally identified by reference numeral 10 and which is constructed in accordance with the teachings of the present invention. As shown, the golf putter head 10 has a body portion 12 that is elongate from side-to-side and which has a front flat face 14. The body 12 has an upper forward flat horizontal surface 16 which is elongate from side to side and which is referred to herein as the lower tier surface 16.

According to the teachings of the present invention, the lower tier surface 16 has a short slot 18 therein which is referred to as being on a lower X axis and which extends downwardly into the lower tier surface a short distance and inwardly perpendicular to the flat front face 14 a short distance.

Also according to the teachings of the present invention, the lower tier surface 16 has two slots 20 and 22 formed therein on opposite sides of the slot 18 and extending in a direction 90 degrees to the X axis, i.e., the axis of the slot 18. These two slots 20 and 22 are considered as lying on the lower Y axis.

Then, from a rear upper surface 24 of the body 12 there extends a riser 26, which is preferably C-shaped as shown, and which extends rearwardly and upwardly from the lower tier surface 16 to an upper tier member 28 which extends forwardly toward the plane of the front flat face or surface 14 and perpendicular thereto.

The upper tier member 28 has an upper tier surface 30 having a slot 32 therein which extends along an upper X axis.

The upper tier member 28 is integral with the riser 26 and both have essentially the same thickness as shown. Then, a forward portion 34 of the upper tier member is provided with an upper cutaway area or notch 36 which has an axis from side to side which is coincident with an upper Y axis and is adapted to be aligned with the slots 20 and 22 on the lower Y axis on the lower tier surface 16.

Also, in a forward surface 37 on the forward portion 34 there is formed a notch 38 in the upper tier member 28. The notch 38 lies in a plane rearwardly of the plane of the front face 14 of the body 12 of the golf putter head 10 and in a plane extending vertically or in a direction that is perpendicular to both the lower Y axis and the lower X axis.

On a forwardly and upwardly facing surface 40 of the riser 26, there is provided a slot 42 which is preferably edged with, or provided on the bottom surface 44 thereof with, a contrasting color, e.g. white, blue or yellow, as compared to a metallic or light bronze color of the remainder of the riser 26 and body 12 integral therewith. As shown, the surface 40 slopes upwardly from the lower tier surface 16 to the upper tier member 28 integral with the riser 26.

Figure 2:
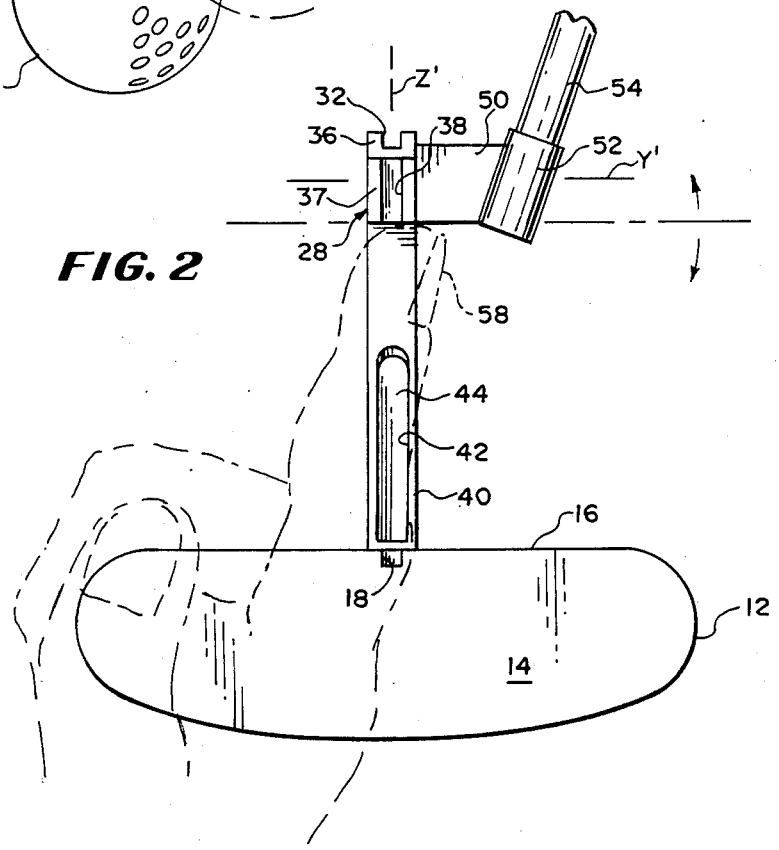
FIG. 2 is a front elevational view of the golf putter head and shows how one can balance the golf putter head underneath an upper tier member thereof.

As shown in FIGS. 1 and 2, an arm extension 50 extends outwardly from one side of the upper tier member 28 and has a boss 52 at the outer end thereof inclined at an angle such as 72 degrees to the horizontal. The lower end of a golf club shaft 54 is received in and fixed in a socket 56 in the boss 52 as shown.

As illustrated in FIGS. 1 and 2, the arm extension extends along a Y' axis which is parallel to the upper tier Y axis and the lower tier Y axis and intersects with a vertical, center of gravity axis Z', extending vertically through the upper tier member 28.

Accordingly, the golf putter head 10 can be balanced on a fulcrum at a point on the underside of the upper tier member 28 at the point of the Z' axis extending through the upper tier member 28. This is illustrated in FIG. 2 where a fingertip 58 acting as a fulcrum is placed underneath the upper tier portion 28 at the point of the Z' axis.

Figure 3:
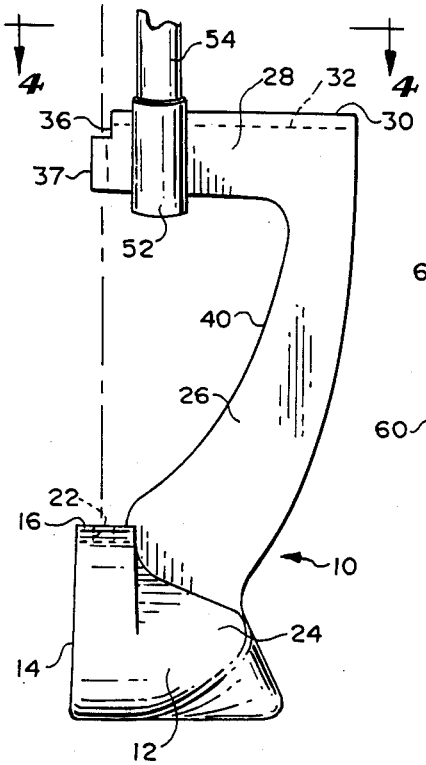
FIG. 3 is a side elevational view of the golf putter head shown in FIGS. 1 and 2.
Figure 10:
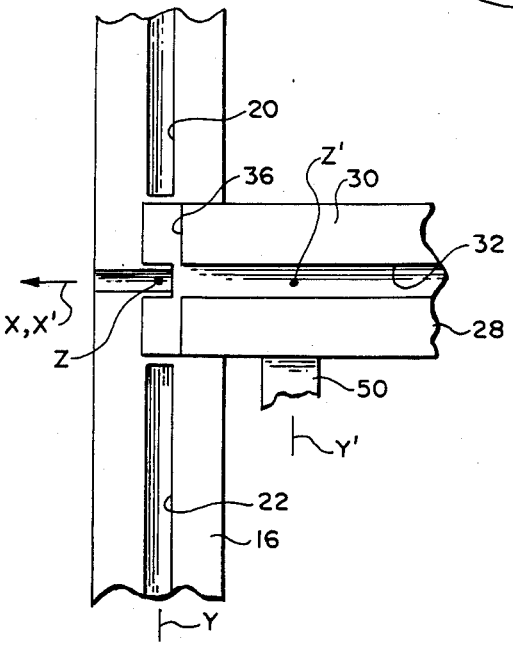
FIG. 10 is an enlarged fragmentary plan view of the golf putter head shown in FIG. 1 and shows the X and Y axis slots in upper and lower tiers of the golf putter head as they should be viewed for proper alignment for accurate putting.

As best shown in FIGS. 3 and 10, the plane of the forward surface 37 of the forward end of the upper tier member 28 lies in a plane that is parallel to and rearwardly of the plane of the front face 14 of the golf putter head 10. As a result, the upper Y axis slot 36 can be aligned with the lower tier Y axis slots 20 and 22 as shown in FIGS. 3 and 10.

Also, of course, as best shown in FIG. 10, the upper tier X axis slot 32 can be aligned with the lower tier X axis slot 18 so that there is both an upper tier and lower tier, X axis and Y axis alignment with the golf putter head 10 of the present invention. This provides for more accurate alignment of the golf putter head 10 with a golf ball 60 and compensates for any astigmatism in the eyes of the player.

FIGS. 1, 3 and 10 illustrate the two tier alignment features to the target line on an X' axis (FIG. 1).

FIG. 2 illustrates the balance feature of heel/toe but does not illustrate the pitch/yaw balance at the same point of balancing.

Figure 4:
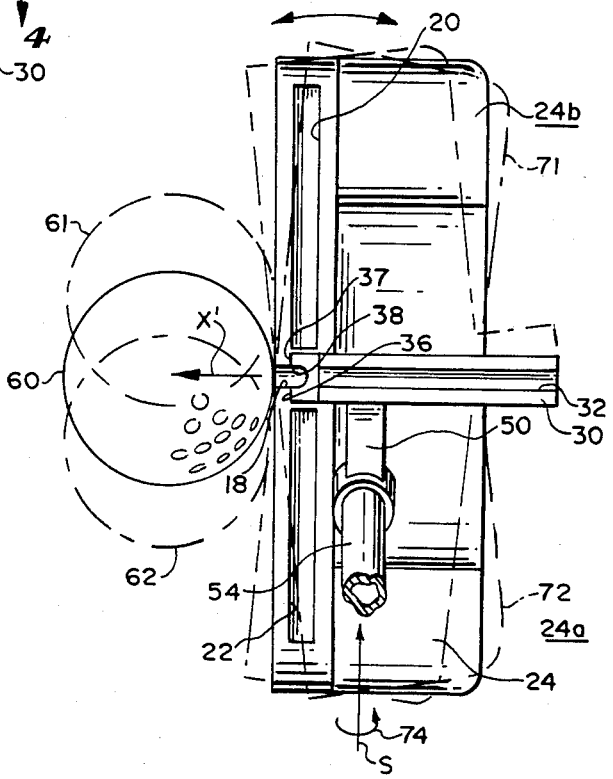
FIG. 4 is a top plan view of the golf putter head, is taken along line 4—4 of FIG. 3 and shows in phantom horizontally rotated offset positions of a putter head if it were not constructed according to the teachings of the present invention and shows such head engaging a golf ball at a point other than at the center of the front face of the putter head.

FIG. 4 illustrates the line of contact along the X' axis with the golf ball 60 from an upper view thereof. It also illustrates the fact that the side-to-side length of the body 12 must be sufficient to provide weight and anti-torque capability for the golf putter head 10 such that if a golf ball 61 or 62 shown in phantom is displaced up to 12½ percent of the side-to-side length of the putter face 14 from the line of impact along the X' axis, the ball will still be hit straight without radial twisting of the golf putter head 10.

There is illustrated in FIG. 4 the torquing or radial twisting of a prior art golf putter head generally identified by reference numerals 71 and 72. With the unique construction of the golf putter head 10 according to the teachings of the present invention and as described above, radial twisting such as about the axis S of the shaft 54 as shown by the arrow 74 is practically nonexistent. In this respect, the golf putter head 10 has been found to be 20 times more resistant to radial twisting along line 74 about the axis S than prior art golf putter heads.

Figure 5:
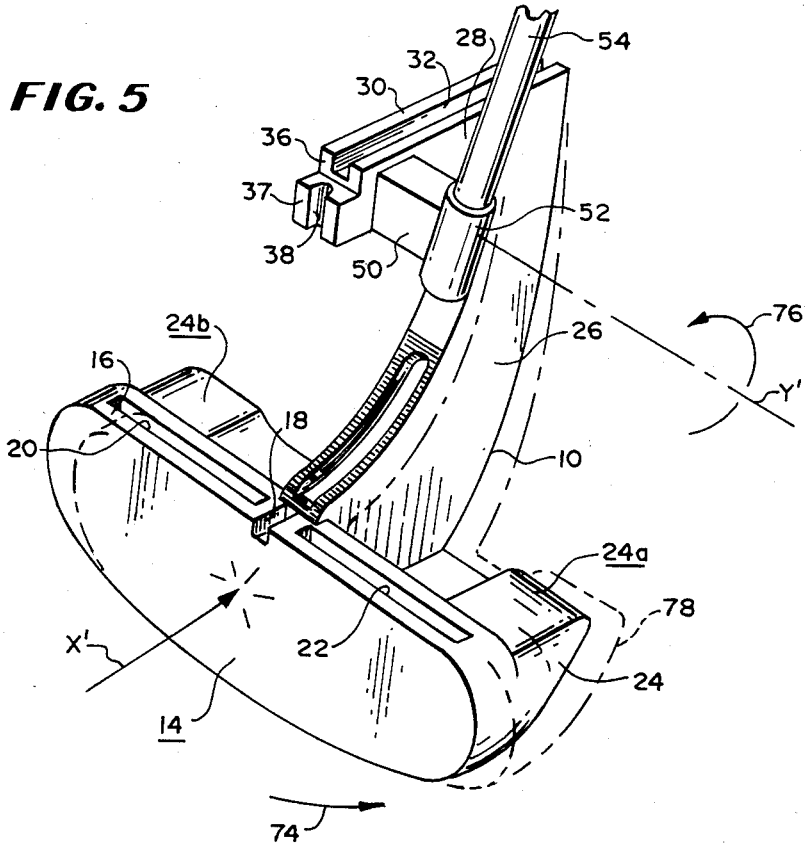
FIG. 5 is another perspective view of the golf putter head similar to the view shown in FIG. 1 and shows in phantom a position of the golf putter head offset slightly to one side.

Instead, and as shown in FIG. 5, a unique feature of the golf putter head 10 of the present invention is that the moment or radial twisting torque normally incurred with prior art golf putter heads is converted to an axial moment or torque about the Y' axis as shown by the arrow 76 when the ball 60 is hit along the desired X' axis of impact or slightly to either side thereof up to 12½ percent of the side-to-side length of the face 14 as illustrated by the phantom position 78 of the golf putter head 10 shown in FIG. 5.

Also, it will be appreciated that a back lower portion **24*a* of the back body portion 24 beneath the arm extension 50 will have less weight than the lower back portion 24*b* of the back body portion 24 on the other side of the tier member 28 opposite the arm extension 50 as shown in FIGS. 4 and 5**.

Also, as illustrated in FIGS. 4 and 5, the slot 42 with the contrasting colored bottom slot surface 44 provides for a coarse adjustment. In this respect, one holding the golf club shaft 54, which is typically about 35 inches long, will look down and make a rough alignment by moving the golf putter head 10 until the colored surface 44 cannot be seen, in other words, until that surface is beneath the upper tier portion 28 and out of sight viewing same from above. This is shown in FIG. 4 where the surface 44 cannot be seen.

Figure 7:
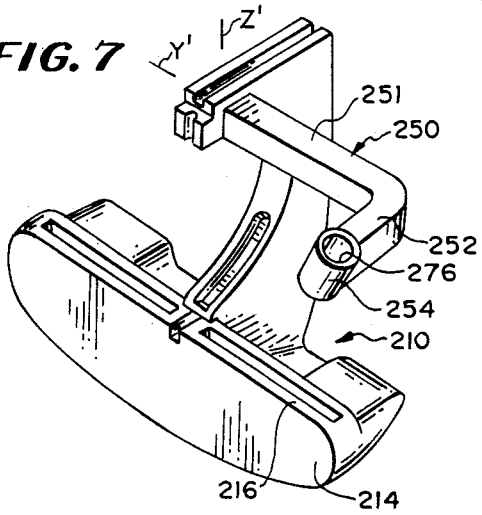
FIG. 7 is a perspective view of another embodiment of the golf putter head of the present invention having a different arm extension for connection to a golf club shaft.
Figure 8:
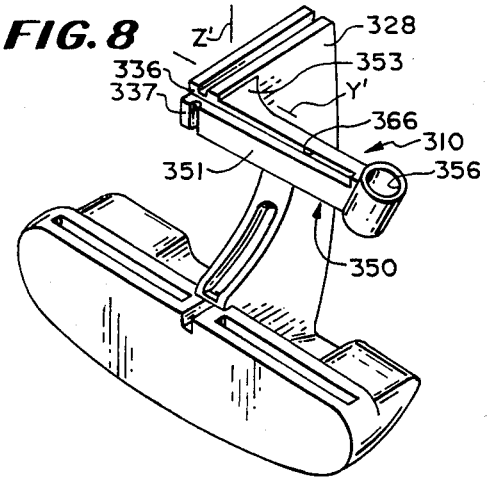
FIG. 8 is a perspective view of still another embodiment of the golf putter head of the present invention having still another arm extension for connection to a golf club shaft.
Figure 9:
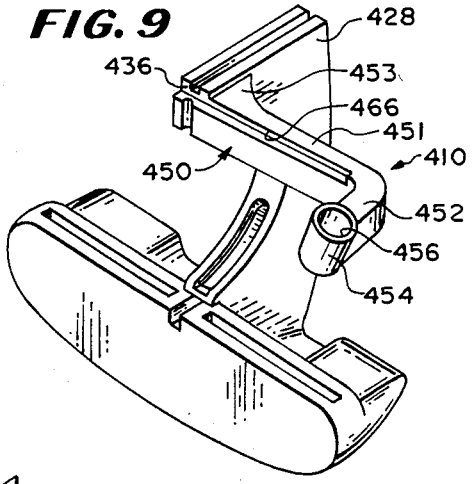
FIG. 9 is a perspective view of still a further embodiment of the golf putter head of the present invention having still another arm extension for connection to a golf club shaft.

In FIGS. 6, 7, 8 and 9 are illustrated modified embodiments of the golf putter head 10 of the present invention. These modifications are identified, respectively, with the reference numerals 110 (FIG. 6), 210 (FIG. 7), 310 (FIG. 8) and 410 (FIG. 9).

Figure 6:
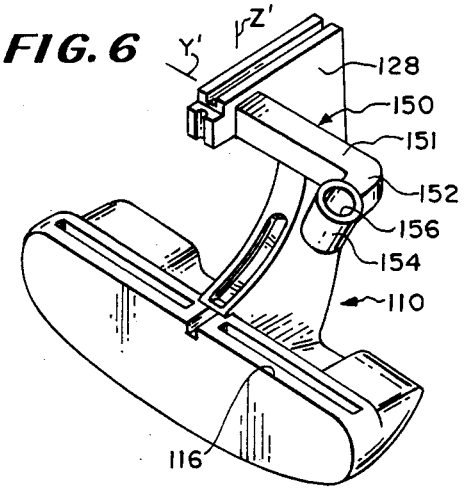
FIG. 6 is a perspective view of another embodiment of the golf putter head having a different arm extension for connection to a golf club shaft.

As shown in FIG. 6, the golf putter head 110 is substantially identical to the golf putter head 10 shown in FIG. 1, except for the fact that it has a longer arm extension 150 which has a first longer arm portion 151 extending outwardly from the upper tier member 128 and a shorter arm portion 152 extending forwardly at a 90 degree angle from the arm portion 151 to form the arm extension 150 with a generally L shape. Then, at the distal end of the short arm portion 152 is a boss 154 having a socket 156 therein. Again, the longer arm portion 151 has an elongate axis coaxial with the Y' axis through the center of gravity axis Z'.

In this embodiment of the golf putter head 110, the boss 154 is located generally over an upward lower tier surface 116.

In FIG. 7, this embodiment of the golf putter head 210 is similar to that shown in FIG. 6 except that it has an arm extension 250 which has a slightly longer first arm portion 251 and a slightly longer arm portion 252 with a boss 254 having a socket 256 which is located forwardly of a front face 214 of the golf putter head 210.

In FIG. 8, the golf putter head 310 has an arm extension 350 which has a front arm face 351 that is coplanar and continuous with a front face 337 of the upper tier member 328. Then, the arm extension 350 at the area of connection thereof (by welding or molding) with the upper tier member 328 has a rearwardly extending arcuate portion 353 which connects with a side of the upper tier portion 328 in the area of the Y' axis so that the point of balancing along the Z' axis underneath the upper tier member 328 is transmitted via the arcuate portion 353 to the arm extension 350 and from there to a boss 354 having a socket 356.

Also, there is provided in the arm extension 350 a notch 366 which is coextensive or continuous with a notch 336 in the front end of the upper tier member 328 along the upper tier Y axis.

The embodiment shown in FIG. 9 is similar to the embodiment shown in FIG. 8 in that an arm extension 450 of the golf putter head 410 has a first arm portion 451 similar to the arm portion 351 shown in FIG. 8 and a second arm portion 452 similar to the arm portion 152 shown in FIG. 6. Then, the arm portion 451 has an arcuate rear portion 453 similar to the arcuate portion 353 shown in FIG. 8 for the same purpose. Additionally, as shown in FIG. 8 the arm portion 451 has an upper tier Y axis notch 466 coextensive with the notch 436 in the forward end portion 428.

Then, in a manner similar to the embodiment 110 of the golf putter head shown in FIG. 6, the arm portion 452 has a boss 454 at the outer end thereof having a socket 456.

From the foregoing description, it will be apparent that the golf putter head 10, 110, 210, 310 or 410 of the present invention has a number of advantages some of which have been described and others of which are inherent in the golf putter head 10, 110, 210, 310 and 410 of the present invention.

In this respect, there is a coarse alignment provided by the upper tier member 28, 128, 228, 328 or 428 and the contrasting colored surface 44 in the notch 42 on the forward surface 40 of the riser 26.

Then, there is a two tier alignment of an upper and lower X axis and an upper and lower Y axis on the respective upper and lower tiers. In this way, true alignment is achieved by superimposing the upper tier X and Y lines or axes onto the X and Y designation lines or axes of the lower tier. In this way, one can visually detect 1 angular degree of true accuracy with respect to heel/toe along the Y axis and pitch/yaw on the X axis.

With the unique construction of applicant's golf putter head 10 with the body portion 12, the riser 26, the upper tier member 328, the arm or arm extension 50, 150, 250, 350 and 450, and the weight distribution portions **24*a* and 24*b* an antiradial twisting feature is incorporated in the golf putter head 10, 110, 210, 310 or 410. In this respect, the moment of inertia is transmitted axially on the target line X axis versus prior art golf putter heads which have a moment of inertia transmitted radially off the target line Y axis. As a result, the golf putter head 10, 110, 210, 310 or 410** is 20 times more resistant to radial twisting versus standard golf putter heads.

The balancing with equal weight distribution provides a balancing of the heels/toe Y axis weight distribution and a pitch/yaw X axis weight distribution.

In use, the golfer determines his line of target (golf ball to golf hole) and places the golf putter head flat surface 14 behind the golf ball with the primary upper surface 30 having the slot 32 on the X axis on the user's determined target line in line with the lower tier X axis and the line of contact X'.

The user then adjusts his stance position distance from the target line by first eliminating from view the "coarse adjustment feature" namely the contrasting colored surface 44 and the slot 42 on the concave surface 40 of the riser 26.

The user then obtains "fine alignment" positioning by superimposing the upper and lower tier X axis or designation lines and Y axis or designation lines. Then, the user swings the golf club and hits the golf ball.

As a result of the unique construction and configuration of applicant's golf putter head 10, 110, 210, 310 or 410, a number of advantages are obtained which can also be described as follows.

The tier alignment feature having the upper tier elevated above and located on exact X axis center lines of the upper and lower tier and intersecting with the putter head surface 14 shows a primary and natural alignment on a chosen target line X' diminishing astigmatic Y axis distortion of conventional Y axis alignment golf putter heads.

The two tier alignment feature contributes to user ability to distinguish accuracy of alignment to the chosen target line X' plus or minus 1/32 of an inch, or 1 angular degree.

The two tier "coarse and fine" alignment features contribute to the user's ability to obtain repetitive distance-from-line-of-target to user's foot positioning plus or minus 1 inch.

The two tier inertial balanced golf putter head 10, 110, 210, 310 or 410 is 100 percent balanced in a heel/toe direction and 100 percent balanced in a pitch/yaw direction. Prior art putters have been found to have at best a 90 percent balance heel/toe with 70 percent pitch and 30 percent yaw balancing.

The two tier inertial balanced golf putter head 10, 110, 210, 310 or 410 has been found to be 20 times more effective in resistance to off-center mishots than conventional golf putter heads having shaft extension/adapters vertically located at the heel area of the golf putter head.

The location of the arm extension shaft/adapter connected to the upper tier member 28, 128, 228, 328 or 428 of the golf putter head 10, 110, 210, 310 or 410 and at the exact gravitational point along the Z' axis and Y' axis which intersect with the X axis converts inertial energy radially on the X axis rather than radially about the Z axis or S axis. This results in an antitwisting feature which is not obtained with conventional golf putter heads that have heel located shaft extensions that transmit inertial energy radially on the Y axis (around the Z axis or S axis - arrow 74) that contributes to twisting of the golf putter head off line from the intended target line as shown in FIG. 4.

Also, it will be understood from the foregoing description that many modifications can be made to the golf putter head 10 of the present invention such as shown, for example, in FIGS. 6–9 (golf putter head 110, 210, 310 or 410) without departing from the teachings of the invention. Accordingly, the scope of the invention is only to be limited as necessitated by the accompanying claims.

I claim:

1. A gold putter head having an elongate side-to-side extending body portion with a front face adapted to be positioned in a generally vertically extending plane and a forward upper face having a short notch extending along an axis which is referred to as the X axis and is perpendicular to the front face and having notches on either side of the short notch extending along an axis defined as a Y axis which is parallel to the plane containing the front face and which is perpendicular to the X axis, a riser portion extending upwardly and rearwardly from the elongate body portion, and an upper tier member extending from an upper end of said riser portion forwardly toward said front face and having an upper surface which has a slot that lies on an upper X axis and a short notch forming a slot in the front forward end thereof which lies on an upper Y axis, the upper and lower X axes being in the same plane and the upper and lower Y axes being in the same plane, and means for connecting a golf club shaft to said riser portion.

2. The golf putter head of claim 1 wherein said riser portion has an upwardly disposed forward surface having indicia thereon for making a coarse alignment of siad upper tier member with said upper face when said upper tier member, in the line of downward sight, is moved over and covers said upper face of said first portion having said indicia thereon.

3. The golf putter head of claim 2 wherein said indicia is in the form of a slot in the upwardly disposed surface of said riser, sand slot having a color different than the color of said golf putter head.

4. The golf putter head of claim 3 wherein said color is on the side walls and bottom of said slot formed in the upper and forward facing surface of said riser portion.

5. The golf putter head of claim 1 wherein said riser includes said upper tier member and is generally C-shaped.

6. The golf putter head of claim 1 wherein said means for connecting a shaft to said riser portion comprise an arm extension attached to a forward side edge of said upper tier member.

7. The golf putter head of claim 6 wherein one side of the body portion extending beneath the arm extension is less in weight than the other side of the body portion extending in a direction away from the arm extension by a weight equal to the weight of the arm extension.

8. The golf putter head of claim 6 wherein said arm extension extends outwardly from said riser portion and along an axis which intersects with a center of gravity axis, said center of gravity axis being defined by a vertical axis which is perpendicular to the X axis and Y axis.

9. The gold putter head of claim 6 wherein said arm extension extends linearly outwardly from one side edge of said upper tier member and has a boss at an outer end thereof.

10. The golf putter head of claim 9 wherein said boss has a socket which has an axis that extends approximately 18° outwardly from a central vertical axis of the putter head and which receives a golf club shaft.

11. The golf putter head of claim 6 wherein said arm extension is L-shaped with a long leg of the L extending outwardly from the upper tier member and a short leg of the L extending forwardly over said forward upper face of said body portion.

12. The golf putter head of claim 6 wherein said arm extension extends outwardly from a side edge of said upper tier member at a position which is forward of the connection of said riser to said upper tier member, said riser portion extending from said upper tier member downwardly and forwardly to said body portion whereby the center of gravity of said golf club head extends through said riser portion and through said body portion and intersects a Y' axis which includes at least a portion of said arm extension to which a golf club shaft is connected such that a moment force or torque force about either the axis of the shaft or the center-of-gravity axis of said golf putter head is inhibited by the weight distributed, and by the above defined interconnection and arrangement of the arm extension, upper tier member, riser portion and body portion of said golf putter head.

13. The golf putter head of claim 12 wherein said body portion has an elongate side-to-side pack portion with a first section thereof beneath said arm extension having less weight than a second section thereof which extends outwardly opposite said arm extension, the weight of said arm extension and said first section being substantially equal to the weight of said second section whereby said golf putter head can be balanced on a fulcrum placed beneath said upper tier member along a vertical center-of-gravity axis of said golf putter head.

14. A golf putter head having an elongate side-to-side extending portion with a front face adapted to be positioned in a generally vertically extending plane, a riser portion extending upwardly and rearwardly from said elongate body portion, an upper tier member extending from an upper end of said riser portion forwardly toward said front face, and an arm extension extending from one side edge of said upper tier member along an axis generally parallel to the axis of said elongate body portion and which first mentioned axis is spaced forwardly of the connection of said upper tier member to said upper end of said riser portion whereby the center of gravity of said golf club head extends through said riser and through said body portion and intersects a Y' axis which includes at least a portion of said arm extension to which a golf club shaft is connected such that a moment force or torque force about either the axis of the shaft or the center-of-gravity axis is inhibited by the interconnection and arrangement of said arm extension, upper tier member, riser portion and body portion of said golf club head.

15. The golf putter head of claim 14 wherein said body portion has an elongate side-to-side back portion with a first section thereof beneath said arm extension having less weight than a second section thereof which extends outwardly opposite said arm extension, the weight of said arm extension and said first section being substantially equal to the weight of said second section whereby the golf putter head can be balanced on a fulcrum placed beneath the upper tier member along a vertical center-of-gravity axis of said golf putter head.

16. A golf putter head having an elongate side-to-side extending body portion with a front face adapted to be positioned in a generally vertically extending plane and an upper face, a riser portion extending upwardly and rearwardly from said elongate body portion, an upper tier member extending from an upper end of said riser portion forwardly toward said front face, and means for connecting a golf club shaft to said riser portion, said riser portion having a forward and upward facing surface which has indicia thereon distinguishable from the color of said golf putter head, said indicia providing a means for algining said upper tier member relative to said upper face on said body portion when said upper tier member, in the light of downward sight, is moved over and covers said surface of said riser having said indicia thereon.

* * * * *